United States Patent [19]

Lonstrup et al.

[11] 4,113,639

[45] Sep. 12, 1978

[54] LUBRICATING OIL COMPOSITION CONTAINING A DISPERSING-VARNISH INHIBITING COMBINATION OF AN OXAZOLINE COMPOUND AND AN ACYL NITROGEN COMPOUND

[75] Inventors: Thorkild F. Lonstrup, Plainfield; Darrell W. Brownawell, Scotch Plains; Edward Goletz, Jr., North Plainfield; Solomon J. Numair, Edison, all of N.J.

[73] Assignee: Exxon Research & Engineering Co., Linden, N.J.

[21] Appl. No.: 741,032

[22] Filed: Nov. 11, 1976

[51] Int. Cl.[2] ..... C10M 1/32; C10M 1/50

[52] U.S. Cl. ..... 252/51.5 A; 260/307 R; 260/307 A

[58] Field of Search ..... 252/51.5 A, 49.6

[56] References Cited

U.S. PATENT DOCUMENTS

| | | | |
|---|---|---|---|
| 2,905,644 | 9/1959 | Butter | 252/51.5 A X |
| 3,966,620 | 6/1976 | Bridger et al. | 252/33.4 |
| 4,035,309 | 12/1977 | Brois | 252/51.5 A X |

FOREIGN PATENT DOCUMENTS

| | | | |
|---|---|---|---|
| 844,616 | 1/1977 | Belgium | 252/51.5 A UX |
| 2,512,201 | 10/1975 | Fed. Rep. of Germany | 252/51.5 A UX |

*Primary Examiner*—Paul F. Shaver

*Attorney, Agent, or Firm*—Roland A. Dexter; Frank T. Johmann

[57] ABSTRACT

The combination of an oil-soluble oxazoline reaction product having a ($\overline{M}_n$) of from about 1,000 to 3500, e.g., the reaction product of polybutenyl succinic anhydride with tris(hydroxymethyl) aminomethane and an oil-soluble acylated nitrogen compound having a ($\overline{M}_n$) of from about 1300 to 8,000, e.g. polybutenyl succinic anhydride reacted with tetraethylene pentamine which nitrogen compound can be borated, if desired, are surprisingly useful as combined additives for lubricating oils to increase the dispersancy and varnish inhibition properties of said oil when one part per weight of said oxazoline reaction product is combined with from 0.2 to 4, preferably 1 to 3, parts by weight of said acylated nitrogen compound.

6 Claims, No Drawings

LUBRICATING OIL COMPOSITION CONTAINING A DISPERSING-VARNISH INHIBITING COMBINATION OF AN OXAZOLINE COMPOUND AND AN ACYL NITROGEN COMPOUND

BACKGROUND OF THE INVENTION

The invention relates to a combination of chemical compositions which are especially useful in lubricating oil systems. More specifically, it relates to a combination of an oxazoline oil additive and an imide oil additive, both of which are known as lubricating oil additives, which markedly improve the sludge dispersancy-varnish inhibiting properties of lubricating oils employed for crankcase lubrication of internal combustion engines.

There are two principle environments which are encountered by automotive crankcase lubricants, i.e. cyclical high and low temperatues from stop-and-go driving and continuous high temperatures from extended operation of the automobile over long distances. Each of these environments poses a primary problem which should be solved if a lubricant is to be regarded as satisfactory. These problems are the result of the inevitable presence in the lubricant of varying proportions of foreign particles such as dirt, soot, water and decomposition products resulting from breakdown of the oil. This foreign matter appears responsible for the deposition of a mayonnaise-like sludge which circulates with the oil. The presence of water and precursors of sludge in lubricating oil seems to depend largely on the operating temperature of the oil. Although at high temperatures the water will be evaporated, breakdown of the oil is accelerated. At low temperatures, water will accumulate and so consequently will provoke the sludging. In ordinary stop-and-go driving, the crankcase lubricant will be alternately hot and cold so that the formation of sludge is a serious problem.

Another principle problem in addition to the sludge which must be overcome by a satisfactory lubricant is varnish deposition which results from the operation of the engine at continuous high temperatures. In such an environment, oil breakdown results in the formation of acidic materials which in themselves corrode the metal surfaces of the bearings, pistons, etc., as well as catalyze the decompostion of the lubricating oil which decomposition is manifested in hard, carbonaceous deposits which accumulate in the piston ring groove and form a varnish on the piston skirts and other metal surfaces.

During the past decade, ashless sludge dispersants have become increasingly important, primarily in improving the performance of lubricants in keeping the engine clean of deposits and permitting extended crankcase oil drain periods while avoiding the undesirable environmental impact of the earlier used metal-containing additives. Most commercial ashless dispersants fall into several general categories. In one category, an amine or polyamine is attached to a long-chain hydrocarbon polymer (the oil solubilizing portion of the molecule), usually polyisobutylene through an acid group, such as a monocarboxylic acid, for example, see U.S. Pat. No. 3,444,170 or a dicarboxylic acid material such as polyisobutenyl succinic anhydride, by forming amide or imide linkages such as described in U.S. Pat. Nos. 3,172,892 and 3,272,746 and may include the reaction product of such materials with boron (see U.S. Pat. Nos. 3,087,936 and 3,254,025). Mixed alkenyl succinimides prepared from a high molecular weight and low molecular weight alkenyl fraction are taught as lubricant dispersants in U.S. Pat. No. 3,401,118. Mixtures of high molecular weight hydrocarbyl (1900 to 5,000) amines and low molecular weight hydrocarbyl (300 to 600) amines are taught as useful for dispersancy/detergency in hydrocarbon fuels (see U.S. Pat. No. 3,898,056).

Reaction products of hydrocarbon substituted succinic anhydride, e.g., polyisobutenylsuccinic anhydride, with compounds containing both an amine group and a hydroxy group have been suggested or investigated in the prior art. For example, United Kingdom Specification 809,001 teaches corrosion inhibitors comprising a multiple salt complex derived from the reaction product of hydrocarbyl substituted dicarboxylic acids and hydroxy amines (including 2-amino-2-methyl-1,3-propanedio [AMP] and tris-(hydroxymethyl)-aminomethane [THAM]. Further, United Kingdom Specification No. 984,409 teaches ashless, amide/imide/ester type lubricant additives prepared by reacting an alkenylsuccinic anhdride, said alkenyl group having 30 to 700 carbon atons, with a hydroxy amine including THAM. This prior art appears to teach that oil additives are formed from hydrocarbyl substituted dicarboxylic acid material, usually alkenyl succinic anhydride, reacted with various amino or hydroxy compounds either through an amide, imide or ester linkage.

In contrast to the foregoing, German (DOS) 2512201 teaches that the reaction of a hydrocarbyl dicarboxylic acid material, i.e. acid or anhydride, or ester, with certain classes of amino alcohols, under certain conditions including metal salt promotion, will result in products containing one or two heterocyclic ring structures, namely, an oxazoline ring, and that products containing at least one oxazoline ring can be tailored for vaious functions, such as anti-rust agents, detergents, or dispersants for oleaginous compositions including lube oil, gasoline, turbine oils and oils for drilling applications. Further DOS 2534921/2 teaches of similar monooxazoline products which can also be modified by rection with phosphorous, boron or oxygen compounds to enhance lubricating oil properties including sludge dispersancy. U.S. Pat. No. 3,966,620 teaches of lubricants containing bis-naphthols as rust inhibitors and the oxazoline reaction product of polyalkenylsuccinic acid and THAM as a dispersant.

SUMMARY OF THE INVENTION

As noted above, the prior art teaches that oil-soluble additives of the acylated nitrogen type and the oxazoline type are each useful for lubricating oils.

It has now been found that the combination of an oil-soluble polyalkenyl oxazoline compound, having a number average molecular weight of about 1000 to 3300, preferably from about 1200 to 3100, optimally from about 1600 to 2800, preferably polybutenyl succinic-bis-oxazoline (obtained from the reaction of polybutenyl succinic anhydride and tris(hydroxymethyl) aminomethane) and an oil-soluble acyl nitrogen compound having a number average molecular weight of about 1300 to 8,000, preferably about 2,000 to 6,000, optimally 3,000 to 5,000, preferably polybutenyl succinimide (obtained from the reactions of polybutenyl succinic anhydride and one molar equivalent of e.g. tetraethylene pentamine) alkylene polyamine exhibits synergistic behavior in dispersancy and/or varnish inhibition when employed in a ratio of one part per weight of the oxazoline compound to from 0.2 to 4, preferably 1 to 3 parts, by weight of the acyl nitrogen compound when said combination is present in at least a dispersing amount in a lubricating oil.

Thus in its broadest concept, the subject matter of the invention is a lubricating oil composition comprising a major amount of lubricating oil and a minor but dispersing amount of a dispersing varnish inhibiting combination of: (a) one part by weight of an oil-soluble oxazoline reaction product having a number average molecular weight (hereinafter designated $(\overline{M}_n)$ of from about 1000 to about 3300 obtained from the reaction of one molar proportion of a hydrocarbyl substituted $C_4$-$C_{10}$ monounsaturated dicarboxylic acid material and from about 1.5 to abut 2 molar proportions of a 2,2-disubstituted-2-amino-1-alkanol having 2 to 3 hydroxy groups and containing a total of 4 to 8 carbons and represented by the formula:

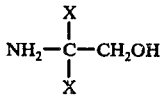

wherein X is an alkyl, or hydroxy alkyl group, with at least one of the X substituents being a hydroxy alkyl group of the structure $-(CH_2)_nzOH$, wherein n is 1 to 3; and, (b) from 0.2 to 4 parts by weight of an oil-soluble acyl nitrogen compound having a $(\overline{M}_n)$ of from about 1300 to 8000 characterized by the presence within its structure of a substantially saturated hydrocarbon-substituted polar group selected from the class consisting of acyl, acylimidoyl, and acyloxy radicals wherein the substantially saturated hydrocarbon substituent contains at least about 50 aliphatic carbon atoms and a nitrogen-containing group characterized by a nitrogen atom attached directly to said polar radical.

In preferred form, the combination is limited to said oxazoline product and nitrogen compound wherein both are derived from hydrocarbyl substituted dicarboxylic acid materials wherein said hydrocarbyl substituent has a $(\overline{M}_n)$ ranging from about 900 to 2800, optimally about 1200 to 2500, i.e. both the acylated nitrogen compound and the oxazoline product are derived therefrom.

DETAILED DESCRIPTION OF THE INVENTION

The hydrocarbyl substituted dicarboxylic acid material, i.e., acid or anhydride, or ester which is used to produce both classes of dispersants includes alpha-beta unsaturated $C_4$ to $C_{10}$ dicarboxylic acid, or anhydrides or esters thereof, such as fumaric acid, itaconic acid, maleic acid, maleic anhydride, chloromaleic acid, dimethyl fumarate, etc., which are substituted with a hydrocarbyl group, usefully a hydrocarbon chain containing at least 50 carbons (branched or unbranched) and includes long hydrocarbon chains, generally an olefin polymer chain.

In general, these hydrocarbyl substituted dicarboxylic acid materials and their prepartion are well known in the art, for example see U.S. Pat. Nos. 3,219,666; 3,172,892; 3,272,746; the aforementioned prior art patents; as well as being commerically available, e.g., polyisobutylene succinic anhydride.

The dicarboxylic acid material can be illustrated by an alkenyl substituted anhydride which may contain a single alkenyl radical or a mixture of alkenyl radicals variously bonded to the cyclic succinic anhydride group, and is understood to comprise such structures as:

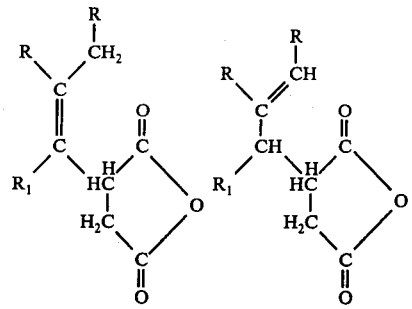

wherein R is hydrogen or lower hydrocarbyl and $R_1$ is hydrocarbyl or substituted hydrocarbyl having from 50 to about 400 and more carbons, and preferably from 65 to about 200 carbons. The anhydrides can be obtained by well-known methods, such as the Ene rection between an olefin and maleic anhydride or halo-succinic anhydride or succinic ester (U.S. Pat. No. 2,568,876). In branched olefins, particularly branched polyolefins, R may be hydrogen or methyl and $R_1$ at least a $C_{50}$ long chain hydrocarbyl group. However, the exact structure may not always be ascertained and the various R and $R_1$ groups cannot always be precisely defined in the Ene products from polyolefins and maleic anhydride.

Suitable olefins include butene, iosbutene, pentene, decene, dodecene, tetradecene, hexadecene, octadecene, eicosene, and polymers of propylene, butene, isobutene, pentene, decene and the like, and halogen-containing olefins. The olefins may also contain cycloalkyl and aromatic groups.

With 2-chloromaleic anhydride and related acylating agents, alkenylmaleic anhydride reactants are formed. Derivatization of these reactants also afford useful imide or oxazoline products.

Preferred olefin polymers for reaction with the unsaturated dicarboxylic acids are polymers comprising a major molar amount of $C_2$ to $C_5$ monoolefin, e.g., ethylene, propylene, butylene, isobutylene and pentene. The polymers can be homopolymers such as polyisobutylene, as well as copolymers of two or more of such olefins such as copolymers of: ethylene and propylene; butylene and isobutylene; propylene and isobutylene; etc. Other copolymers include those in which a minor amount of the copolymer monomers, e.g., 1 to 20 mole % is a $C_4$ to $C_{18}$ non-conjugated diolefin, e.g., a copolymer of isobutylene and butadiene; or a copolymer of ethylene, propylene and 1,4-hexadinee; etc.

The olefin polymers will usually have $(\overline{M}_n)$s within the range of about 700 and about 3,000, more usually between about 900 and about 2800. Particularly useful olefin polymers have $(\overline{M}_n)$s of about 1200 to 2500 with approximately one terminal double bond per polymer chain. An especially valuable starting material for a highly potent dispersant additive are polyalkenes e.g., polyisobutylene, having about 80 carbons.

OIL-SOLUBLE OXAZOLINE REACTION PRODUCT

Generally, useful oil-soluble oxazoline reaction products and their methods of preparation are fully described in German Patent Application DOS 2512201 which is fully incorporated herein by reference thereto. This oxazoline dispersant which forms a portion of the inventive combination can be characterized in its preferred form as an oil-soluble product obtained from heating together a molar equivalent of a hydrocarbon substituted $C_4$-$C_{10}$ mono-unsaturated dicarboxylic acid material having more than about 50 carbon atoms per dicarboxylic acyl group and from 1.5 to about 2 molar equivalents of a 2,2-disubstituted-2-amino-1-alkanol having 2 to 3 hydroxy groups and containing a total of 4 to 8 carbons at a temperature of from about 140° C. to 240° C. until cessation of water evolution indicating completion of the oxazoline reaction. This reference amino-alkanol which readily produces the oxazoline rings requisite for this dispersant according to this invention can be represented by the formula

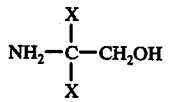

wherein X is an alkyl, or hydroxy alkyl group, with at least one of the X substituents being a hydroxy alkyl group of the structure $-(CH_2)_nOHm$ wherein $n$ is 1 to 3.

Examples of such 2,2-disubstituted amino-alkanols, include 2-amino-2-methyl-1,3-propanedioal, 2-amino-2-(hydroxymethyl)-1,3-propanediol (also known as tris(-hydroxymethyl-)aminomethane or THAM), 2-amino-2-ethyl-1,3-propanediol, etc. Because of its effectiveness, availability, and cost, the THAM is particularly preferred. It is to be noted that other amino alcohols such as ethanolamine, propanolamine and butanolamine which lack the 2,2-disubstitution, do not afford the oxazoline product. The requisite $(\overline{M}_n)$ ranges of these products have already been specified.

The formation of the preferred oxazoline dispersants in high yield, can be effected by adding about 1.5 to 2 mole equivalent of the aforesaid 2,2-disubstituted-2-amino-1-alkanol per mole equivalent of the dicarboxylic acid material, with or without an inert diluent, and heating the mixture at 140°-240° C., optimally 170°-220° C. and preferably 180°-205° C. for ½ to 24, more usually 2 to 8 hours, until the reaction is complete.

Completion of the oxazoline reaction can be readily ascertained by using periodic infrared spectral analysis for following oxazoline formation (oxazoline peak forms at 6.0 microns), or by the cessation of water evolution of about 2.3 to 3.0 moles of water.

Although not necessary, the presence of small amounts, such as 0.01 to 2 wt. %, preferably 0.1 to 1 wt. % based on the weight of the reactants, of a metal salt can be used in the reaction mixture as a catalyst. The metal catalyst can be later removed by filtration or by washing a hydrocarbon solution of the product with a lower alcohol, such as methanol, ethanol, isopropanol, etc., or an alcohol/water solution.

Alternatively, the metal salt can be left in the reaction mixture, as it appears to become stably dispersed, or dissolved, in the reaction product and depending on the metal, it can contribute performance benefits to the lubricating oil. This is believed to occur with the use of zinc catalysts in lubricants.

Inert solvents which may be used in the oxazoline reaction include hydrocarbon oils, e.g., mineral lubricating oil, kerosene, neutral mineral oils, xylene, halogenerated hydrocarbons, e.g., carbon tetrachloride, dichlorobenzene, tetrahydrofuran, etc.

Metal salts that may be used as promoters or catalysts include carboxylic acid salts of Zn, Co, Mn, Ni and Fe. Metal catalysts derived from strong acids (HCl, sulfonic acids, $H_2SO_4$), HNO, etc.) and bases tend to diminish the yield of the oxazoline products and instead favor imide or ester formation. For this reason, these strong acid salts or basic salts are not preferred and usually will be avoided. The carboxylic acids used to prepare the desired promoters include $C_1$ to $C_{18}$, e.g., $C_1$ to $C_8$ acids, such as the saturated or unsaturated mono- and dicarboxylic aliphatic hydrocarbon acids, particularly fatty acids. Specific examples of such desired carboxylic acid salts include zinc acetate, zinc formate, zinc propionate, zinc stearate, manganese(ous) acetate, iron tartarate, cobalt(ous) acetate, nickel acetate, etc. Zinc salts such as zinc acetate and zinc oxide, are preferred. Metal salts include the oxides.

It is preferred that the metal salt promoter be present at or near the onset of the reaction for greatest effect. The zinc salt promoter gradually dissolves by forming, inter alia, zinc complexes with the oxazoline product. Significantly and unexpectedly, the presence of zinc in the oxazoline product apparently contributes performance benefits to the lubricating oil.

While not known with complete certainty, it is believed that the reaction of the hydrocarbyl substituted dicarboxylic acid material, e.g., a substituted succinic anhydride with the amino alcohol of the invention, e.g., about 1.5 to 2 equivalents of 2,2-disubstutitued-2-aminomethanol such as tris-hydroxymethylaminomethane (THAM), gives oxazoline, e.g. a mixture of monooxazoline and bis-oxazoline to all bis-oxazoline via the intermediacy of several discrete reaction species. If an acid anhydride is used, the initial transformation appears to involve the scission of the anhydrideby the amino function of one mole of the amino alcohol to yield an amic acid. Addition of another mole equivalent of amino alcohol is believed to form the amic acid amine salt, which then upon further heating, undergoes cyclodehydration to the final bis-oxazoline product.

The promoting effect of metal salts, such as zinc acetate ($ZnAc_2$), on oxazoline formation is very likely ascribable to the favorable polarization of the amide group by the zinc salt towards attack by the hydroxy function of the amino alcohol reactant. It is believed that the dissolved zinc salt ultimately coordinates with the oxazoline ring.

ACYL NITROGEN COMPOUND

The acyl nitrogen compound is of that calss of oil-soluble dispersants broadly described in U.S. Pat. No. 3,272,746 (it is incorporated herein by reference thereto) as an oil-soluble acylated nitrogen compound characterized by the presence within its structure of a substantially saturated hydrocarbon-substituted polar group selected from the class consisting of acyl, acylimidoyl, and acyloxy radicals wherein the substantially saturated hydrocarbon substitutent contains at least about 50 aliphatic carbon atoms and a nitrogen-containing group characterized by a nitrogen atoms attached directly to said polar radical. For the purposes of this invention, these acyl nitrogen compounds have a $(\overline{M}_n)$ ranging from about 1300 to 8000, preferably from about 2000 to 6000 and optimally from about 3000 to 5000. All $(\overline{M}_n)$ values set forth in this specification have been determined by Vapor Pressure Osmometry (VPO).

The relative polar groups of teh acyl nitrogen compound are represented by the structural configurations as follows:

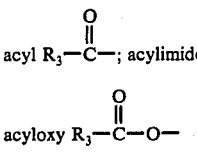

where $R_3$ is the substantially saturated hydrocarbon substituent extensively discussed earlier as the hydrocarbyl (including the preferred alkenyl) substituent of th dicarboxylic acid material and $R_4$ represents a hydrogen radical or a hydrocarbyl group (including polar substituted hydrocarbyls, e.g. Cl substituted).

The nitrogen-containg group of the acylated nitrogen compositions of this invention is derived from compounds characterized by a radical having the structural configuration

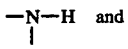

the two reamining valences of the nitrogen atom of the above

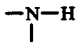

radical preferably are satisfied by hydrogen, amino, or organic radicals bonded to said nitrogen atom through direct carbon-to-nitrogen linkages. Thus, the compounds from which the nitrogen-containing group may be derived include aliphatic amines, aromatic amines, heterocyclic amines or carbocyclic amines. The amines may be primary or secondary amines and preferably are polyamines such as alkylene amines, arylene amines, cyclic polyamines, and the hydroxy-substituted derivatives of such polyamines.

The preferred acyl nitrogen compounds are essentially described as the imides and diimides, preferably diimides, resulting from the reaction of 1 to 2.5, preferably about 2.0 to 2.2, molar proportions of the dicarboxylic acid material with one molar proportion of a nitrogen compound having one or more amino groups. Such a preferred compound can be represented by the structural formula

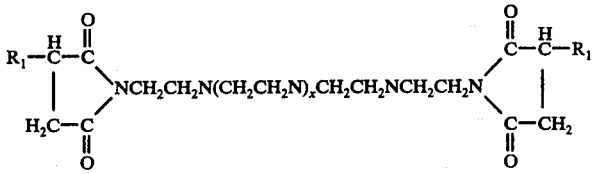

wherein X is a number from 0 to 5, etc., when 2 molar proportions of the dicarboxylic acid material is reacted with one molar proportion of said nitrogen compound having one of more amine groups and $R_1$ is the same as earlier defined.

Useful nitrogen compounds include mono- and polyamines of about 2 to 60, e.g. 3 to 20 total carbon atoms and about 1 to 12, e.g. 2 to 6 nitrogen atoms in the molecule. The amine compounds may be hydrocarbyl amines or may include hydroxy groups, alkoxy groups, amide groups or may be cyclic in structure such as imidazolines and the like. Preferred amines both as noted above generally and for preparation of said imides and diimides are aliphatic, saturated amines including those of the general formulae:

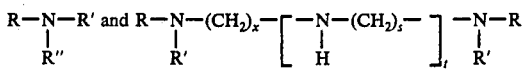

wherein R, R′ and R″ are independently selected from the group consisting of hydrogen; $C_1$ to $C_{12}$ straight or branched chain alkyl radicals; $C_1$ to $C_{12}$ alkoxy $C_2$ to $C_6$ alkylene radicals; $C_2$ to $C_{12}$ hydroxy or amino alkylene radicals; and $C_1$ to $C_{12}$ alkylamino $C_2$ to $C_6$ alkylene radicals; s is a number of from 2 to 6, preferably 2 to 4; and t is a number of from 0 to 10, preferably 2 to 6.

Non-limiting examples of suitable amine compounds include: mono- and di- tallow amines; 1,2-diaminoethane; 1,3-diaminopropane; 1,4-diaminobutane; 1,6-diaminohexane; diethylene triamine; triethylene tetramine, tetraethylene pentamine; 1,2-propylene diamine; di-(1,2-propylene) triamine, di-(1,3-propylene) triamine, N,N-dimethyl-1,3-diaminopropane; N,N-di-(2-aminoethyl) ethylene diamine; N,N-di-(2-hydroxyethyl)-1,3-propylene diamine; 3-dodecyloxypropylamine; N-dodecyl-1,3-propane diamine; tris-hydroxymethyl methylamine, diisopropanol amine, and diethanol amine.

Other useful amine compounds include: alicyclic diamines such as 1,4-bis-(aminomethyl) cyclohexane, and heterocyclic nitrogen compounds such as imidazolines and N-aminoalkyl piperazines of the general formula:

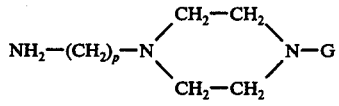

wherein G is independently selected from the group consisting of hydrogen and Ω aminoalkylene radicals of from 1 to 3 carbon atoms; and p is an integer of from 1 to 4. Non-limiting examples of such amines include 2-pentadecyl imidazoline; N-(2-aminoethyl) piperazine; N-(3-aminopropyl) piperazine; and N,N′-di-(2-aminoethyl) piperazine.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and isomeric piperazines. Low cost poly(ethyleneamines) compounds having a composition approximating tetraethylene pentamine (used for the preparation of the acyl nitrogen compounds of the subsequent Examples herein) are available commercially under the trade name Polyamine 400 (PA-400), marketed by Jefferson Chemical Co., New York, NY. Similar material may be made by the polymerization of aziridine, 2-methyl aziridine and acetidine.

Still other amines with amino groups separated by hetero atom chains such as polyethers or sulfides can be used.

Amination of the dicarboxylic acid material is usefully carried in a solution reaction with the dicarboxylic acid material dissolved in a solvent such as mineral oil. The formation of the imide dispersants in high yield can be effected by adding from about 0.4 to 1, preferably about 0.45 to 0.5, molar proportions of alkylene polyamine per molar proportion of dicarboxylic acid material of the nitrogen compound to said solution and heating the mixture at 140° C. to 165° C. until the appropriate amount of water of reaction is evolved.

In some applications, it is useful to modify the acyl nitrogen dispersant by subsequent boration as generally taught in U.S. Pat. Nos. 3,087,936 and 3,254,025 (incorporated herein by reference thereto). This is readily accomplished by treating said acyl nitrogen dispersant with a boron compound selected from the class consisting of boron oxide, boron halides, boron acids and esters of boron acids in an amount to provide from about 0.1 atomic proportion of boron for each mole of said acylated nitrogen composition to about 10 atomic proportions of boron for each atomic proportion of nitrogen of said acylated nitrogen composition. Usefully the dispersants of the inventive combination contain from about 0.3 to 0.9 wt. % boron based on the total weight of said borated acyl nitrogen compound. The boron, which appears to be in the product as dehydrated boric acid polymers (primarily $(HBO_2)_3$), attaches chemically to the dispersant imides and diimides as amine salts e.g. the metaborate salt of said diimide.

Treating is readily carried out by adding from about 1 to 3 wt. % (based on the weight of said acyl nitrogen compound) of said boron compound, preferably boric acid which is most usually added as a slurry to said acyl nitrogen compound and heating with stirring and at from about 135° C. to 165° C, for from 1 to 5 hours followed by nitrogen stripping at said temperature ranges. Filter the borated product, if desired.

THE OXAZOLINE REACTION PRODUCT AND ACYL NITROGEN COMPOUND COMBINATION

The combination of oil-soluble dispersants according to the invention can be incorporated in a wide variety of lubricants. They can be used in lubricating oil compositions, such as automotive crankcase lubricating oils, automatic transmission fluid, etc., in concentrations generally within the range of about 0.05 to 10 wt. %, for example, 0.5 to 5 wt. %, preferably 1.5 to 3 wt. % of the total composition. As noted, in general, the additive combination of the invention will comprise one part by weight of the oxazoline reaction product per about 0.2 to 4, preferably 1 to 3, optimally 2 to 3 parts by weight of said acyl nitrogen compound. The lubricating oil to which the synergistic combination can be added include not only hydrocarbon oils derived from petroleum but also includes synthetic lubricating oils such as polyethylene oils; alkyl esters of dicarboxylic acids; complex esters of dicarboxylic acid, polyglycol and alcohol; alkyl esters of carbonic or phosphoric acids; polysilicones; fluorohydrocarbon oils; and, mixtures of lubricating oils and synthetic oils in any proportion, etc. The term "lubricating oil" for this disclosure includes all the foregoing. The useful combination may be conveniently dispensed as a concentrate of 10 to 80 wt. % of said synergistic combination in 20 to 90 wt. % of mineral oil, for example, kerosene, with or without other additives being present. In the above compositions or concentrates, other conventional additives may also be present including dyes, pour point depressants, antiwear agents such as tricresyl phosphate or zinc dialkyl dithiophosphates of 3 to 8 carbon atoms in the alkyl groups, antioxidants such as n-phenylalpha-naphthylamine, tertiary-octyl phenol sulfide, and 4,4'-methylene bis(2,6-di-tert. butyl phenol), viscosity index improvers such as ethylene-propylene copolymers, polymethacrylates, polyisobutylene, alkyl fumarate-vinyl acetate copolymers and the like, de-emulsifiers such as polysiloxanes, ethoxylated polymers and the like.

It has been noted that in those combinations of the oxazoline reaction product and acyl nitrogen compounds according to this invention that when the $(\overline{M}_n)$ of said oxazoline is about 30% to 60% of the $(\overline{M}_n)$ acyl nitrogen compound exceptionally potent dispersant-varnish inhibition is imparted to the lubricating oil, e.g. $(\overline{M}_n)$ of ~ 1700 for the oxazoline and ~3400 for the acyl nitrogen.

This invention will be further understood by reference to the following examples, which include preferred embodiments of the invention.

EXAMPLE 1

A mixture of 500 gm. (0.4 moles) of polyisobutenyl succinic anhydride having a Saponification No. of 89 and a $(\overline{M}_n)$ of 980, 500 ml. of mineral lubricating oil (Solvent 150 Neutral) as solvent, 4 gm. of zinc acetate dihydrate ($ZnAc.2H_2O$) as a promoter and 96.8 gm. (0.8 mole) of THAM was charged into a glass reactor fitted with thermometer, stirrer and a Deane-Starke moisture trap, and heated. Heating at about 180° C. for four hours gave the expected quantity of water, i.e., about 1.1 moles of water in the trap. After filtration and roto-evaporation, the concentrate (50 wt. % of the reaction product) analyzed for 1.00 wt. % nitrogen, and 0.06 wt. % zinc. The product had a $(\overline{M}_n)$ of about 1400.

The polyisobutenylsuccinic anhydride used herein (also used in Example 2) was prepared by conventional technique, namely the reaction of chlorinated polyisobutylene having a chlorine content of about 3.5 wt. %, based on the weight of chlorinated polyisobutylene, and an average of 70 carbon atoms in the polyisobutylene group, with maleic anhydride at about 200° C.

EXAMPLE 2

A borated derivative of the reaction product of polyisobutenyl succinic anhydride and an alkylene polyamine was prepared by first condensing 2.1 moles of polyisobutenyl succinic anhydride, having a Saponification Number of 89 and a $(\overline{M}_n)$ of 980, dissolved in Solvent Neutral 150 mineral oil to provide a 50 wt. % solution with 1 mole of tetraethylene pentamine (hereafter noted as TEPA). The polyisobutenyl succinic anhydride solution was heated to about 150° C. with stirring and the polyamine was charged into the reaction vessel over a 4-hour period which was thereafter followed by a 3-hour nitrogen strip. The temperature was maintained from about 140° C. to 165° C. during both the reaction with the TEPA and the subsequent stripping. While the resulting imidated product was maintained at a temperature of from about 135 to about 165° C. a slurry of 1.4 moles of boric acid in mineral oil was added over a 3-hour period which was thereafter followed by a final 4-hour nitrogen strip. After filtration and rotoevaporation, the concentrate (50 wt. % of the reaction product) contained about 1.5 wt. % nitrogen and 0.3 wt. % boron. The product had a ($\overline{M}_n$) of about 2420.

EXAMPLE 3

In the same manner as Example 2, 2.1 moles of polyisobutenyl succinic anhydride (Sap. No. of 103 and an $\overline{M}_n$ of about 1300) was utilized in place of the polyisobutenyl succinic anhydride of Example 2. The resulting concentrate (50 wt. % active ingredient) analyzed for 1.46% nitrogen and 0.32% boron.

EXAMPLE 4

The general process of Example 1 was used, however in this instance, one mole of polyisobutenyl succinic anhydride (having a Saponification Number of 103 and a ($\overline{M}_n$) of 1300) dissolved to 50 wt % in S150 Neutral mineral oil was heated with 0.036 moles of zinc acetate dihydrate and 1.9 moles of THAM at a temperature of from 168° to 174° C. At the end of the THAM addition, the reaction mixture is sparged with nitrogen at 177° C. for 10 hours. After rotoevaporation, the concentrate (50 wt. % active ingredient) analyzed for 1.0 wt. % nitrogen and 0.1 wt. % zinc. The product had a ($\overline{M}_n$) of about 1700.

EXAMPLE 5

The general process of Example 2 was used, however 1.3 moles of polyisobutenylsuccinic anhydride was used and boration was not undertaken. The ($\overline{M}_n$) of the product was about 1520.

EVALUATION OF COMBINATIONS IN VARNISH INHIBITION TEST

Each test sample consisted of 10 grams of lubricating oil containing 0.07 of a gram of the addition concentrate (50% active) which results in a total of 0.35 wt. % additive present in the test sample. The test oil to which the additive is admixed was 9.93 grams of a commercial lubricating oil obtained from a taxi after 2,000 miles of driving with said lubricating oil. Each ten gram sample was heat soaked overnight at about 140° C. and thereafter centrifuged to remove the sludge. The supernatant fluid of each sample was subjected to heat cycling from about 150° C. to room temperature over a period of 3.5 hours at a frequency of about 2 cycles per minute. During the heating phase, the gas containing a mixture of about 0.7 volume percent $SO_2$, 1.4 volume percent NO and balance air was bubbled through the test samples and during the cooling phase water vapor was bubbled through the test samples. At the end of the test period, which testing cycle can be repeated as necessary to determine the inhibiting effect of any additive, the wall surfaces of the test flasks in which the samples were contained are visually evaluated as to the varnish inhibition. The amount of varnish imposed on the walls is rated at values of from 1 to 7 with the higher number being the greater amount of varnish. It has been found that this test correlates with the varnish results obtained as a consequence of carrying out an MSVC engine test. The results which are recorded in Table I indicate that combinations of the oxazoline reaction product and the acyl nitrogen compound exhibit enhanced behavior when their weight ratios range from about one part by weight of the acyl nitrogen compound to from 0.2 to 3 parts by weight of the oxazoline compound; with a synergistic result when the polalkenyl substituent of each has a ($\overline{M}_n$) of about 1300 and about 3 parts by weight of the acyl nitrogen compound is combined with 1 part by weight of the oxazoline reactant.

TABLE I

| Test Sample | Weight Percent of Additive Added to Test Oil: Additive of Example 2 | Additive of Example 3 | Additive of Example 4 | Additive of Example 5 | VIB Rating |
|---|---|---|---|---|---|
| 1 | 0.35 | — | — | — | 6 |
| 2 | 0.26 | — | 0.09 | — | 5 |
| 3 | 0.18 | — | 0.18 | — | 4 |
| 4 | 0.09 | — | 0.26 | — | 5 |
| 5 | — | — | 0.35 | — | 7 |
| 6 | — | 0.35 | — | — | 5.5 |
| 7 | — | 0.26 | 0.09 | — | 3 |
| 8 | — | 0.18 | 0.18 | — | 4 |
| 9 | — | 0.09 | 0.26 | — | 5 |
| 10 | — | — | 0.35 | — | 6 |
| 11 | — | — | — | 0.35 | 7 |
| 12 | — | — | 0.09 | 0.26 | 7 |
| 13 | — | — | 0.18 | 0.18 | 5 |
| 14 | — | — | 0.26 | 0.09 | 5 |
| 15 | — | — | 0.35 | — | 6 |

EXAMPLE 6

Three fully formulated lubricating oil blends were prepared by blending five volume percent of the concentrate of Example 1, five volume percent of the concentrate of Example 2 and five volume percent of a 50/50 mixture of the concentrate of Example 1 and Example 2, respectively, with a SAE 30 lubricating oil of Solvent 450 N base stock containing about 0.6 wt. % zinc dialkyl dithiophosphate (hereafter noted as ZDDP) and 0.6 wt. % calcium phenate sulfide.

Each of the blends prepared as described above was subjected to the MS Sequence VC Engine Test which is a test well known in the automotive industry. The test is run in a Ford engine of 302 cubic inch displacement following the procedure described in the publication entitled "Multi-Cylinder Test Sequences for Evaluating Automotive Engine Oil" (ASTM Special Publication 315-E). At the end of each test, various parts of the engine are rated on a merit basis wherein 10 represents a perfectly clean part, and lesser numbers represent increasing degrees of deposit formation. The various ratings are then totaled and averaged on the basis of 10 as a perfect (completely clean) rating. The results obtained with the three blends described above are given in Table II.

TABLE II

MS SEQUENCE VC TEST RESULTS
MERIT RATINGS (BASIS 10)

| | Additive of the Concentrate of Example: 1 | 2 | 1:2 |
|---|---|---|---|
| Sludge Merit | 8.89 | 9.43 | 9.14 |
| Varnish Merit | 7.76 | 7.97 | 7.70 |
| Piston Skirt Varnish Merit | 7.68 | 8.04 | 8.42 |

The results set forth above shown that synergism does exist for a 50/50 mixture of an oxazoline reaction product and an acyl nitrogen dispersant compound in the merit ratings of the piston skirt varnish. These results when viewed in concert with the data of Tables III and IV indicates that the optimum range of this combination is from about 1 to 3 parts by weight of acyl nitrogen dispersant to 1 part by weight of oxazoline reaction product.

EXAMPLE 7

Three fully formulated lubricating oil blends were prepared comparable to those set forth in Example 6 except that the two combined dispersants were both prepared from polyisobutylene succinic anhydride in which the ($M_n$) of the hydrocarbyl substituent is about 1300 rather than 980, i.e. the additives of Examples 3 and 4 are combined. These three blends were prepared by blending 5 wt. % of the concentrate of Example 3, 5 wt. % of the concentrate of Example 4 and 5 wt. % of a mixture of the combination of the concentrates of Examples 3 and 4 (2 wt. parts of Ex. 3 to 1 wt. part of Ex. 4), respectively, with a lubricating oil blend of two neutral base oils and formulated with about 0.79 wt. % of metal detergent (calcium sulfonate overbased to a 400 TBN), 0.66 wt. % zinc dialkyl dithiophosphate and 0.12 wt. % isoprene-styrene polymer viscosity index improver to provide a fully formulated SAE 10W-40 lubricating oil.

The results of the MS Sequence VC Engine Test on the several formulations are set forth in Table III. TBN represents total base number and refers to the milligrams of KOH required to neutralize a one gram sample according to ASTM Method D-2896.

TABLE III

| | MS SEQUENCE VC TEST RESULTS MERIT RATINGS (BASIS 10) | | | | | | |
|---|---|---|---|---|---|---|---|
| | 5.0 Wt.% Concn. of Ex. 2 | 5 Wt.% of 2 pts. Concn. Ex. 2 and 1 Part of Concn. Ex. 4 | 5.0 Wt.% Concn. of Ex. 3 | 5.0 Wt.% Concn. of Ex. 4 | 5 Wt.% 2 pts. Concn. of Ex. 3 to 1 Pt. Concn. of Ex. 4 | 4.5 Wt.% of 2 Parts Concn. 3 to 1 Pt. Concn. of Ex. 4 | 4.0 Wt.% 2 Pts. Concn. Ex. 3 to 1 Pt. Concn. Ex. 4 |
| Sludge | 8.00 | 8.54 | 8.14 | 7.66 | 9.39 | 8.89 | 8.14 |
| Ave. Varnish | 7.68 | 8.13 | 8.21 | 8.62 | 8.50 | 8.18 | 8.45 |
| Piston Skirt Varnish | 7.64 | 8.16 | 7.80 | 8.09 | 8.80 | 8.17 | 7.86 |

Concn. represents Concentrate.

The data of Table II shows that the combination of dispersants has synergistic activity in the MS VC Engine Test both as to sludge merit and piston skirt varnish merit ratings.

EXAMPLE 8

The merit ratings realized from a MS Sequence VC Engine Test on the optimum combination of the invention shows that the combination includes a ratio ranging between 1 part of the oxazoline reaction product to 2 to 3 parts by weight of the acyl nitrogen compound (dispersants are derived from a polyisobutenylsuccinic anhydride having a hydrocarbyl substituent of ($\overline{M}_n$) of about 1300). The additives were incorporated into a SAE 30 lubricating oil of blended neutral distillate and bright stock modified with about 0.4 wt. % magnesium sulfonate, 0.1 wt. % calcium phenate sulfide and 0.6 wt. % zinc dialkyl dithiophosphate. The respective merit ratings are shown in Table IV.

TABLE IV

| | MS SEQUENCE VC TEST RESULTS MERIT RATINGS (BASIS 10) | | |
|---|---|---|---|
| | 4 Wt. % Concn.* Ex. 4 | 4 wt. % Combination 2 wt. parts Ex. 3 to 1 wt. part Concn.* of Ex. 4 | 3 wt. parts Concn. Ex. 3 to 1 wt. part Concn.* of Ex. 4 |
| Sludge | 8.4 | 9.1 | 8.7 |
| Average Varnish | 7.3 | 8.1 | 8.0 |

TABLE IV-continued

| | MS SEQUENCE VC TEST RESULTS MERIT RATINGS (BASIS 10) | | |
|---|---|---|---|
| | 4 Wt. % Concn.* Ex. 4 | 4 wt. % Combination 2 wt. parts Ex. 3 to 1 wt. part Concn.* of Ex. 4 | 3 wt. parts Concn. Ex. 3 to 1 wt. part Concn.* of Ex. 4 |
| Piston Skirt Varnish | 7.6 | 8.0 | 8.0 |

*Indicates a 50 wt.% active ingredient Concentrate.

A highly useful concentrate according to this invention is about 50 wt. % diluent as a neutral mineral oil, e.g. S150N, and 50 wt. % of the invention combination in preferred form i.e. the products of Examples 3 and 4 in a weight ratio of one part of said oxazoline reaction product and one to three parts of said acyl nitrogen compound. Such a concentrate can be represented thus by about 50 wt. % of mineral oil dilute, about 17% of the bis-oxazoline of poly(isobutenyl) succinic anhydride wherein said poly(isobutenyl) has a ($\overline{M}_n$) of about 1300 and about 33 wt. % of borated tetraethylene pentamino-diimide of poly(isobutenyl) succinic anhydride wherein said poly(isobutenyl) has a ($\overline{M}_n$) of about 1300 and said concentrate contains about 1.3 wt. % nitrogen and about 0.2 wt. % boron. The oxazoline dispersant in useful form for this disclosure can be generally termed a bisoxazoline since at least about 60% of the

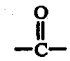

groups of the dicarboxylic acid material have been incorporated into the oxazoline structure.

It is to be understood that the examples present in the foregoing specification are merely illustrative of this invention and are not intended to limit it in any manner, nor is the invention to be limited by any theory regarding its operability. The scope of the invention is to be determined by the appended claims.

It is possible to provide some or all of the boron, i.e. up to about 0.03 wt. % in lubricating oils is useful for varnish inhibition, to the inventive combination by means of a borated oxazoline reaction compound produced according to the general teachings of DOS 2534921 and 2534922. The oxazoline product can contain from about 0.3 to 0.9 wt. % boron.

The inventive combination also provides rust inhibition properties to formulated lubricating oils generally superior to comparable amounts of known acyl nitrogen dispersants.

What is claimed is:

1. A lubricating oil composition comprising a major amount of lubricating oil and a minor but dispersing amount of a dispersing and varnish inhibiting combination of: (a) one part by weight of an oil-soluble oxazoline reaction product having a number average molecular weight of from about 1,000 to about 3,300 obtained from the reaction of one molar proportion of a hydrocarbyl substituted $C_4$-$C_{10}$ monounsaturated dicarboxylic acid material wherein said hydrocarbyl substituent contains at least 50 aliphatic carbon atoms, and from about 1.5 to about 2 molar proportions of a 2,2-disubstituted-2-amino-1-alkanol having 2 to 3 hydroxy groups and containing a total of 4 to 8 carbons and represented by the formula:

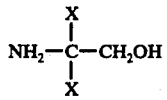

wherein X is an alkyl, or hydroxy alkyl group, with at least one of the X substituents being a hydroxy alkyl group of the structure $—(CH_2)_nOH$, wherein n is 1 to 3; and, (b) from 0.25 to 4 parts by weight of an oil-soluble acylated nitrogen compound having a number average molecular weight ranging from about 1,300 to 8,000 characterized by the presence within its structure of a substantially saturated hydrocarbon-substituted polar group selected from the class consisting of acyl, acylimidoyl, and acyloxy radicals wherein the substantially saturated hydrocarbon substituent contains at least about 50 aliphatic carbon atoms and a nitrogen-containing group characterized by a nitrogen atom attached directly to said polar radical.

2. A composition according to claim 1 wherein said combination is present in from about 0.05 to 10 wt. % based on the total weight of said composition, said hydrocarbyl substituted dicarboxylic acid material is poly(alkenyl)succinic anhydride with said poly(alkenyl) substituent having a number average molecular weight of from about 900 to about 2800, said substantially saturated hydrocarbon-substituted polar group is poly(alkenyl)succinic anhydride with said poly(alkenyl) substituent having a number average molecular weight of from about 900 to about 2800 and said amino-1-alkanol is tris-(hydroxymethyl) aminomethane and said nitrogen containing group being an alkylene polyamino substituent having from 2 to 60 carbon atoms and from 2 to 6 nitrogen atoms.

3. A composition according to claim 2 wherein said oxazoline reaction product contains from 0.1 to 2 weight percent of zinc and said acylated nitrogen compound contains from 0.3 to 0.9 weight percent boron.

4. A composition according to claim 2 wherein both said poly(alkenyl) substituents have a $(\overline{M}_n)$ of from about 1100 to about 2000, said oxazoline reaction product has a $(\overline{M}_n)$ ranging from 1200 to 3100, said acyl nitrogen compound has a $(\overline{M}_n)$ ranging from 2000 to 6000, and said oil composition contains from about 0.05 to 10 wt. %, based on the total weight of said composition of said combination which consists of one part by weight of (a) to from about 1 to 3 parts by weight of (b).

5. A composition according to claim 4 wherein said oxazoline reaction product is obtained from the reaction of one molar proportion of a poly(butenyl) $C_4$-$C_{10}$ monounsaturated dicarboxylic acid material with said poly(butenyl) substituent having $(\overline{M}_n)$ of about 1300 and about two molar proportions of said tris(hydroxymethyl) aminomethane at a temperature of from about 160° C to about 220° C. until cessation of water evolution and said acyl nitrogen compound is obtained from the reaction of about two molar proportions of a poly(-butenyl) substituted succinic anhydride material with said poly(butenyl) substituent having a $(\overline{M}_n)$ of about 1300 with about one molar proportion of tetraethylene pentamine at a temperature of from about 140° C. to about 165° C. until about 2 molar proportions of water has evolved followed by condensation with boric acid at a temperature of from about 135° C. to about 165° C.

6. A concentrate comprising from about 10% to about 90% by weight of mineral oil and from about 10% to about 80% by weight of the dispersant combination of: (a) a bis-oxazoline of poly(isobutenyl) succinic anhydride having a $(\overline{M}_n)$ of about 1700; and, (b) a borated alkylene polyamino-diimide of poly(isobutenyl) succinic anhydride having a $(\overline{M}_n)$ of about 3400, the weight ratio of (a) to (b) ranging from about 1 to 3.

* * * * *